US005626122A

United States Patent [19]

Azuma

[11] Patent Number: 5,626,122

[45] Date of Patent: May 6, 1997

[54] AIR-FUEL RATIO CONTROL APPARATUS FOR AN INTERNAL COMBUSTION ENGINE

[75] Inventor: Tadahiro Azuma, Tokyo, Japan

[73] Assignee: Mitsubishi Denki Kabushiki Kaisha, Tokyo, Japan

[21] Appl. No.: 596,767

[22] Filed: Feb. 5, 1996

[30] Foreign Application Priority Data

Mar. 20, 1995 [JP] Japan ..... 7-060436

[51] Int. Cl.[6] ..... F02D 41/14

[52] U.S. Cl. ..... 123/685; 123/698

[58] Field of Search ..... 123/520, 674, 123/685, 698

[56] References Cited

U.S. PATENT DOCUMENTS

| | | | |
|---|---|---|---|
| 5,216,997 | 6/1993 | Osanai et al. | 123/698 |
| 5,544,638 | 8/1996 | Yuda | 123/674 |
| 5,546,922 | 8/1996 | Hara et al. | 123/698 |

FOREIGN PATENT DOCUMENTS 5-52139 3/1993 Japan .

*Primary Examiner*—Tony M. Argenbright

*Attorney, Agent, or Firm*—Sughrue, Mion, Zinn, Macpeak & Seas

[57] ABSTRACT

An air-fuel ratio control apparatus for an internal combustion engine includes an operative state detection unit for detecting an operative state of the internal combustion engine, a purge quantity calculation unit for calculating a quantity of purge air and a purge rate calculation unit for calculating a purge rate from the purge air quantity calculated by the purge quantity calculation unit and from the operative state detected by the operative state detection unit. A purge air concentration calculation unit calaulates a purge air concentration from the purge rate and the air-fuel ratio feedback correction coefficient. A purge air concentration correction unit calculates a purge air concentration correction coefficient based on the purge rate and the purge air concentration, and a fuel injection quantity calculation unit calculates an injection quantity of fuel, based on the air-fuel ratio feedback correction coefficient and the purge air concentration correction coefficient.

5 Claims, 10 Drawing Sheets

FIG. 5

BASIC PURGE CONTROL VALVE "ON" TIME

PRGBSE (Ne,Ec) UNIT : [ms]

| CHARGING EFFICIENCY Ec [%] | ENGINE SPEED Ne [rpm] | | | | | | | |
|---|---|---|---|---|---|---|---|---|
| | 1000 | 1250 | 1500 | 2000 | 2500 | 3000 | 3500 | 4000 |
| 6.25 | 0 | 0 | 0 | 0 | 13 | 15 | 20 | 20 |
| 12.50 | 0 | 0 | 0 | 0 | 23 | 26 | 30 | 37 |
| 18.75 | 15 | 18 | 21 | 27 | 34 | 39 | 46 | 54 |
| 25.00 | 19 | 23 | 27 | 36 | 43 | 50 | 60 | 70 |
| 37.50 | 29 | 36 | 42 | 56 | 68 | 80 | 93 | 107 |
| 50.00 | 46 | 57 | 68 | 90 | 103 | 120 | 143 | 167 |
| 62.50 | 80 | 100 | 120 | 158 | 200 | 214 | 255 | 255 |
| 75.00 | 255 | 255 | 255 | 255 | 255 | 255 | 255 | 255 |

PURGE FLOW REFERENCE VALUE

QPRGBSE (Ne,Ec) UNIT : [g/sec]

| CHARGING EFFICIENCY Ec [%] | ENGINE SPEED Ne [rpm] | | | | | | | |
|---|---|---|---|---|---|---|---|---|
| | 1000 | 1250 | 1500 | 2000 | 2500 | 3000 | 3500 | 4000 |
| 6.25 | 0.000 | 0.000 | 0.000 | 0.000 | 0.075 | 0.087 | 0.102 | 0.120 |
| 12.50 | 0.000 | 0.000 | 0.000 | 0.000 | 0.146 | 0.178 | 0.204 | 0.234 |
| 18.75 | 0.089 | 0.111 | 0.133 | 0.176 | 0.224 | 0.269 | 0.311 | 0.359 |
| 25.00 | 0.121 | 0.148 | 0.178 | 0.238 | 0.293 | 0.350 | 0.414 | 0.477 |
| 37.50 | 0.179 | 0.226 | 0.265 | 0.356 | 0.445 | 0.535 | 0.623 | 0.720 |
| 50.00 | 0.240 | 0.300 | 0.358 | 0.481 | 0.582 | 0.701 | 0.831 | 0.975 |
| 62.50 | 0.294 | 0.368 | 0.442 | 0.581 | 0.736 | 0.856 | 1.000 | 1.066 |
| 75.00 | 0.260 | 0.153 | 0.166 | 0.179 | 0.268 | 0.260 | 0.191 | 0.278 |

AIR-FUEL RATIO CONTROL APPARATUS FOR AN INTERNAL COMBUSTION ENGINE

BACKGROUND OF THE INVENTION

1. Field of the Invention

The present invention relates to an air-fuel ratio control apparatus for an internal combustion engine, and more particularly to such apparatus provided with an air-fuel ratio feedback control function and a purge control function.

2. Description of the Related Art

It has so far been performed in an internal combustion engine to-absorb an evaporative fuel generated from a fuel tank with activated charcoal and to purge it into an intake system.

Also, there is an internal combustion engine which performs a feedback control of an air-fuel ratio so that in the fuel injection unit the air-fuel ratio of the air-fuel mixture becomes a stoichiometric air-fuel ratio. When, in an internal combustion engine such as this, an evaporative fuel has not been given purge processing, an air-fuel ratio feedback correction coefficient fluctuates with a reference value, for example, 1.0 as center. If the purge processing is started, the air-fuel ratio feedback correction coefficient will assume a less value, because an injection quantity of fuel has to be reduced by the quantity of the purged evaporative fuel.

At the time of this purge processing, a deviation from the reference value of the air-fuel ratio feedback correction coefficient assumes various values, depending upon the operative state of the internal combustion engine, i.e., a ratio of a quantity of purge air to a quantity of intake air (hereinafter referred to as a purge rate). The air-fuel ratio feedback correction coefficient is also set so that it varies relatively slowly with a certain integration coefficient in order to avoid an abrupt variation in the air-fuel ratio. Therefore, when the purge rate varies by a transient operation during purge processing, it takes time for the air-fuel ratio feedback correction coefficient to get from a value obtained before the variation in the purge rate to a value obtained after the variation, and consequently, during this period the air-fuel ratio does not come to be maintained to a stoichiometric air-fuel ratio.

Then, an apparatus such as described below has been proposed in Japanese Patent Laid-Open No. 5-52139.

This internal combustion engine comprises first injection quantity correction means for correcting an injection quantity of fuel with an air-fuel ratio feedback correction coefficient, purge air concentration calculation means for calculating a purge air concentration per target purge rate, based on a shift in the air-fuel ratio feedback correction coefficient which occurs when purge processing is performed, and second injection quantity correction means for reducing a quantity of fuel, based on the product of the purge air concentration and the purge rate when the purge processing is performed. In the internal combustion engine, the maximum purge rate, which is a ratio of a quantity of purge air and a quantity of intake air at the time of the full open state of a purge control valve, is stored in advance, and the duty ratio of the purge control value is set to target purge rate/maximum purge rate so that the target duty ratio is gradually increased when the purge processing is started. When the air-fuel ratio feedback correction coefficient is less than a predetermined value and rich, a purge air concentration coefficient is increased at a constant value by a constant value and also the shift in the air-fuel ratio feedback correction coefficient is reflected in the purge air concentration coefficient at a constant rate at intervals of 15 seconds from the start of the purge processing, thereby forcibly bringing the air-fuel ratio feedback correction coefficient close to 1.0. Thus, the duty ratio of the purge control valve is controlled so that the purge rate becomes constant independently of the operative state of the engine, and even when the purge rate varies, the injection quantity is corrected with the product of the purge rate and the purge air concentration, thereby preventing the shift in the air-fuel ratio at the time of the transition.

However, even if the duty ratio of the purge control valve is controlled so that the purge rate becomes constant and also even if the injection quantity is corrected with the product of the purge rate and the purge air concentration, it takes substantial time to completely calculate the purge air concentration. In other words, it takes substantial time for the air-fuel ratio feedback correction coefficient to become 1.0. For this reason, there is the problem that, until the purge air concentration is completely calculated, the air-fuel ratio cannot be maintained to the stoichiometric air-fuel ratio at the time of the transition from the purge cut state to the purge state, at the time of the transition from the state where the purge rate at the time of an intermediate load can be assured by several percents to the state where the purge rate becomes near 0 as at the time of a high load, or at the time of the return from the high-load state.

SUMMARY OF THE INVENTION

The present invention has been made to solve the above-described problems and accordingly, an important object of the invention is to provide an air-fuel control apparatus for an internal combustion engine which is capable of precisely controlling an air-fuel ratio, which is introduced into the internal combustion engine, to a target value at all times.

Another important object of the invention is to provide an air-fuel control apparatus for an internal combustion engine where, even if a transient operation were performed during purge control, there would be no possibility that the air-fuel ratio fluctuates.

Still another important object of the invention is to provide an air-fuel control apparatus for an internal combustion engine which is capable of accurately and quickly calculating a purge air concentration.

A further important object of the invention is to provide an air-fuel control apparatus for an internal combustion engine where them is no possibility that the purge air concentration is learned by mistake.

A further important object of the invention is to provide an air-fuel control apparatus for an internal combustion engine which is capable of shortening an initial purge quantity reducing time which reduces a quantity of purge air at the initial operative stage of the internal combustion engine.

According to one aspect of the invention, there is provided an air-fuel ratio control apparatus for an internal combustion engine, comprising: operative state detection means for detecting an operative state of the internal combustion engine; purge quantity control means for controlling a quantity of purge air that is introduced into an engine intake system, based on a detection output of the operative state detection means; purge quantity calculation means for calculating the purge air quantity that is introduced into the engine intake system by the purge quantity control means; purge rate calculation means for calculating a purge rate from the purge air quantity calculated by the purge quantity calculation means and from the operative state detected by the operative state detection means; an air-fuel ratio sensor for sensing an air-fuel ratio of an air-fuel mixture supplied to the internal combustion engine; air-fuel ratio control means for controlling an air-fuel ratio feedback correction coefficient which makes a correction so that the air-fuel ratio of the air-fuel mixture, which is supplied to the internal combustion engine, becomes a target value, based on an output of the air-fuel ratio sensor; purge air concentration calculation means for calculating a purge air concentration from the purge rate and the air-fuel ratio feedback correction coefficient; purge air concentration correction means for calculating a purge air concentration correction coefficient, based on the purge rate and the purge air concentration; and fuel injection quantity calculation means for calculating an injection quantity of fuel which is supplied to the internal combustion engine, based on the air-fuel ratio feedback correction coefficient and the purge air concentration correction coefficient.

With this arrangement, the purge air concentration is calculated from a shift in the air-fuel ratio feedback correction coefficient and the purge rate at the time of the introduction of purge air. Based on the purge air concentration and the purge rate, the purge air concentration correction coefficient is calculated, and based on the air-fuel ratio feedback correction coefficient and the purge air concentration correction coefficient, an injection quantity of fuel which is supplied to the internal combustion engine is calculated.

In a preferred form of the invention, the air-fuel ratio feedback correction coefficient is controlled to the target value by correcting the injection quantity of fuel in accordance with the purge rate and the purge air concentration.

In another preferred form of the invention, the air-fuel ratio control apparatus for an internal combustion engine further comprises purge air concentration learning value calculation means for filtering the purge air concentration calculated by the purge air concentration calculation means and then calculating a purge air concentration learning value. When the purge air concentration calculation means calculates the purge air concentration for the first time after starting of the internal combustion engine, a result of the calculation is set to the purge air concentration learning value without filtering the result of the calculation.

In still another preferred form of the invention, the air-fuel ratio control apparatus for an internal combustion engine further comprises inhibition means for inhibiting updating of the purge air concentration when the purge rate is less than a predetermined value.

In a further preferred form of the invention, an increase rate of the purge air quantity, which is incremented after starting of the internal combustion engine, is made greater after calculation of the purge air concentration than before the calculation.

BRIEF DESCRIPTION OF THE DRAWINGS

The present invention will be described in further detail with reference to the accompanying drawings, in which:

FIG. 5 is a diagram showing a basic purge control valve "ON" time and a purge flow reference value;

DETAILED DESCRIPTION OF THE PREFERRED EMBODIMENT

A preferred embodiment of the present invention will hereinafter be described with reference to the accompanying drawings.

Figure 1:
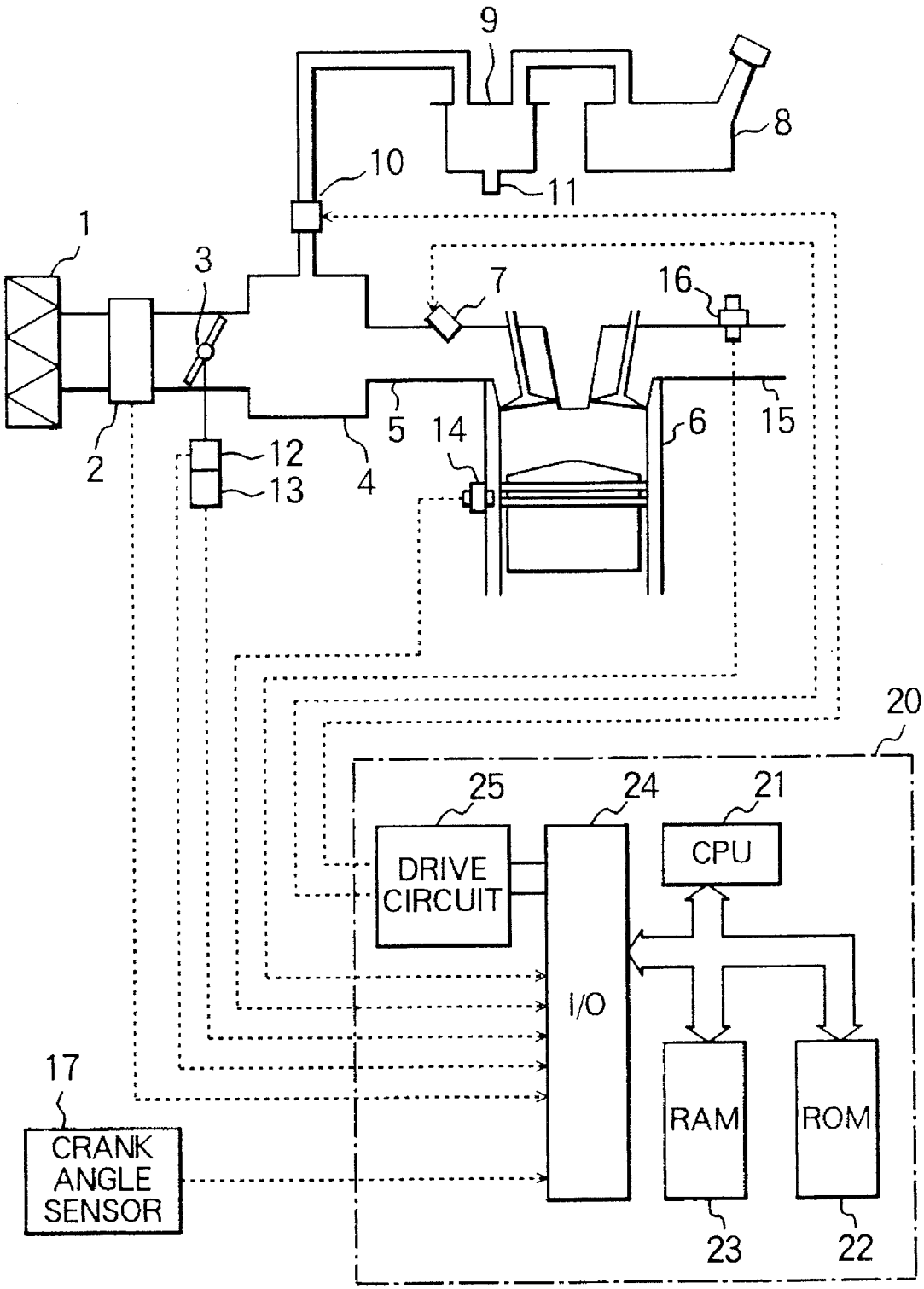
FIG. 1 is a schematic view showing the constitution of the present invention.

FIG. 1 schematically illustrates the constitution of the present invention. In FIG. 1, reference numeral 1 denotes an air cleaner. A quantity of intake air ($Q_a$), cleaned by the air cleaner 1, is measured by an air flow sensor 2. The quantity of the intake air is controlled according to load by a throttle valve 3, and the intake air is sucked into each cylinder of an engine 6 through a surge tank 4 and an intake pipe 5. On the other hand, fuel is injected into the intake pipe 5 through an injector 7. Also, an evaporative fuel which generates in a fuel tank 8 is absorbed by a canister 9 having activated charcoals incorporated therein. A purge control valve 10 is opened according to a purge valve control quantity which is determined by the operative state of the engine 6. When air, introduced through a canister atmospheric inlet 11 by the negative pressure in the surge tank 4, passes through the activated charcoals of the canister 9, the air includes the evaporative fuel removed from the activated charcoals and is supplied into the surge tank 4 as purged air.

An engine control unit 20, which performs various kinds of controls such as an air-fuel control and an ignition-timing control, is constituted by a microcomputer comprising a central processing unit (CPU) 21, a read-only memory (ROM) 22, and a random access memory (RAM) 23. The engine control unit 20 takes in an intake air quantity $Q_a$ sensed by an air flow sensor 2, a throttle opening ratio +e,sez -+ee sensed by a throttle sensor 12, and a signal of an idle switch 13 which is turned on at the time of idling, through an input-output interface 24. The engine control unit 20 further takes in an engine cooling water temperature WT sensed by a water-temperature sensor 14, an air-fuel feedback signal $O_2$ from an air-fuel ratio sensor 16, and an engine speed (number of revolutions) $N_e$ sensed by a crank angle sensor 17.

Note that the air flow sensor 2, the throttle sensor 12, the idle switch 13, the water-temperature sensor 14, the air-fuel ratio sensor 16, and the crank angle sensor 17 as a whole constitute operative-state detection means.

The CPU 21 performs an air-fuel ratio feedback control calculation, based on a control program and various kinds of maps stored in the ROM 22, and drives the injector 7 through a drive circuit 25.

The engine control unit 20 performs various kinds of controls such as an ignition-timing control, an exhaust gas recirculation (EGR) control, and an idling speed control. The engine control unit 20 also outputs a canister purge signal and drives the purge control valve 10 so that a canister purge operation such as described above is performed, according to the operative state of the engine, for example, when the engine speed $N_e$ is greater than a predetermined value after completion of idling of engine where the engine cooling-water temperature WT is greater than a predetermined value 10. In addition, the engine control unit 20, at the time of the idling operative state, detects this state by means of the signal of the idle switch 13 and turns off the purge control value 10, thereby cutting the canister purge processing.

Figure 2:
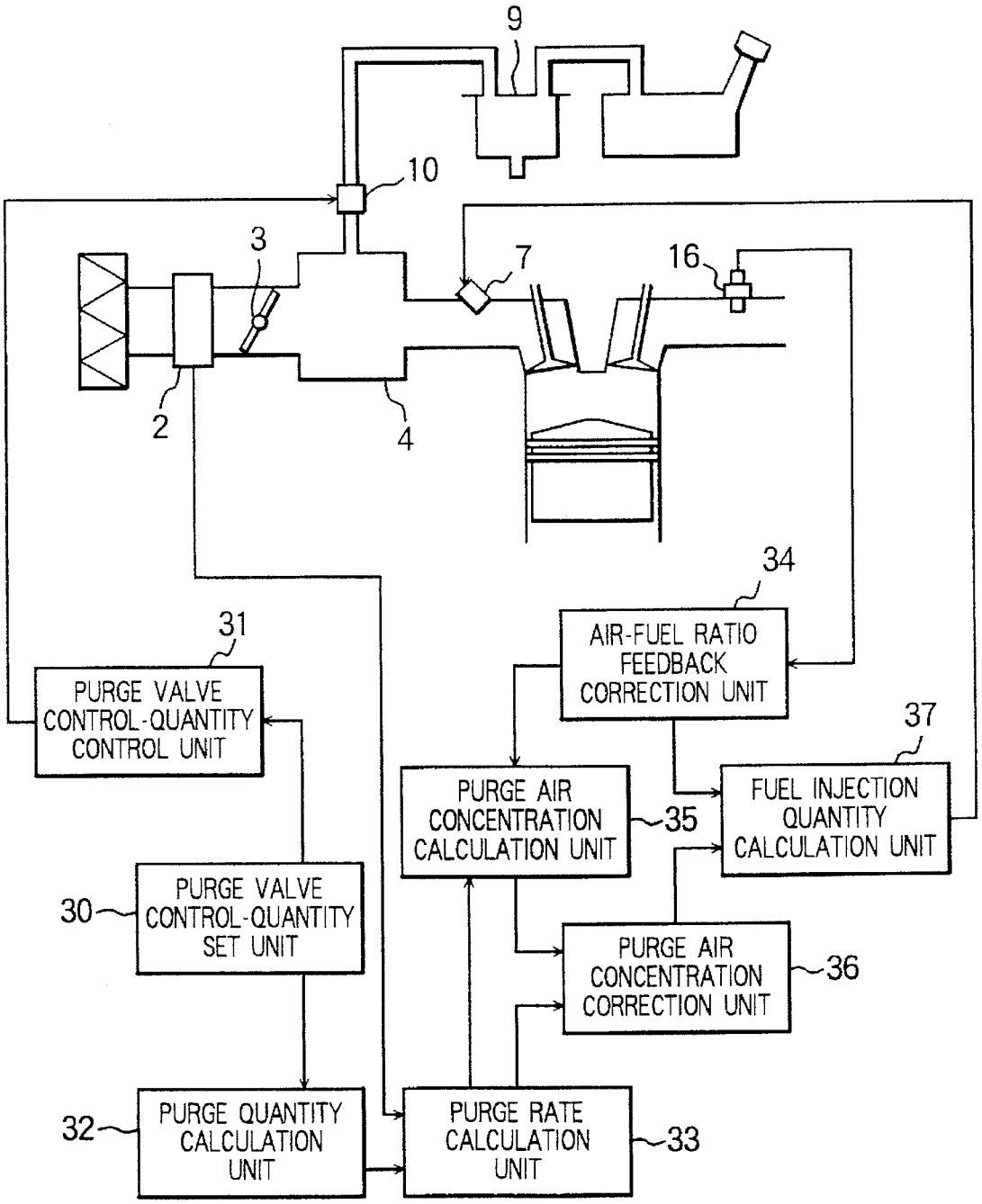
FIG. 2 is a block diagram showing the control blocks of the present invention.

FIG. 2 shows the control blocks of the present invention. In FIG. 2, a purge valve control quantity set unit 30 detects an operative state of the engine 6, based on information obtained from the aforementioned sensors, and sets a quantity of purge air which is determined according to this operative state. A purge valve control quantity control unit 31 controls an opening ratio of the purge control valve 10 in accordance with the quantity of purge air that was set by the purge valve control quantity set unit 30. The purge valve control quantity set unit 30 and the purge valve control quantity control unit 31 as a whole constitute purge quantity control means. A purge quantity calculation unit 32 calculates a quantity of purge air which is introduced into an intake pipe 5, based on the purge valve control quantity that was set by the purge valve control quantity set unit 31. A purge-rate calculation unit 33 calculates a purge rate, based on the quantity of intake air sensed by the air flow sensor 2 and the quantity of purge air calculated by the purge quantity calculation unit 32. An air-fuel ratio feedback correction unit 34 constitutes air-fuel ratio control means which calculates an air-fuel ratio feedback correction coefficient for correcting an injection quantity of fuel so that an air-fuel ratio becomes a target air-fuel ratio, based on the sensed output of the air-fuel ratio sensor 16. A purge air concentration calculation unit 35 calculates a purge air concentration, based on a shift in the air-fuel ratio feedback correction coefficient which occurs when purge processing is performed and on a purge rate. A purge air concentration correction unit 36 calculates a purge air concentration correction coefficient for correcting an injection quantity of fuel, based on a shift in the air-fuel ratio feedback correction coefficient which occurs when purge processing is performed and on a purge rate. A fuel injection quantity unit 37 calculates an injection quantity of fuel, based on the air-fuel ratio feedback correction coefficient and the purge air concentration correction coefficient.

In the engine shown in FIG. 2, a fuel injection quantity $Q_f$ is basically calculated based on the following equation.

ti $Q_f=\{(Q_a/N_e)/\text{target air-fuel ratio}\}\times C_{FB}\times C_{RPG}\times K+\alpha+tm$ (1)

where $Q_a$ is the quantity of intake air, $N_a$ is the engine speed, $C_{fb}$ is the air-fuel ratio feedback correction coefficient, $C_{PFG}$ is the purge air concentration correction coefficient, and K and α are correction coefficients 1 and 2.

The K of the correction coefficient 1 is a multiplication constant of idle correction coefficients, and the of of the correction coefficient 2 is a constant which is added as an increase in acceleration. Normally, when no correction is needed, K is 1.0 and α is 0. The purge air concentration correction coefficient $C_{PRG}$ corrects an injection quantity of fuel, based on a purge concentration and a purge-rate, when purge processing is performed. When purge processing is not performed, $C_{PRG}$ is 1.0. The air-fuel feedback correction coefficient $C_{FB}$ controls an air-fuel ratio to a target air-fuel ratio, based on an output signal of the air-fuel ratio sensor 16. Although any air-fuel ratio may be used as a target air-fuel ratio, in this embodiment a description will be made of a case where a stoichiometric air-fuel ratio is used as a target air-fuel ratio.

As described above, when in the aforementioned conventional technique the air-fuel ratio is shifted from a target air-fuel ratio due to the purge control, this shift is corrected by the air-fuel feedback correction coefficient $C_{FB}$, but it takes substantial time to correct the air-fuel ratio to the target air-fuel ratio because it takes substantial time to update the air-fuel ratio feedback correction coefficient CFB.

Then, the present invention is aimed at the aforementioned equation (1), and at the time of the purge control, the air-fuel ratio is controlled so that it becomes the target air-fuel ratio by updating the purge air concentration correction coefficient $C_{PRG}$. At this time, the air-fuel ratio feedback correction coefficient $C_{FB}$ which takes time to be updated is maintained at a predetermined value.

Therefore, since there is no need to update the air-fuel ratio feedback correction coefficient $C_{FB}$ which takes time to be updated, the air-fuel ratio can be quickly controlled so that it becomes the target air-fuel ratio.

The air-fuel ratio sensor 16 generates an output voltage of 0.9 V or so when the air-fuel ratio is on the rich side and also generates an output voltage of 0.1 V or so when the air-fuel ratio is on the thin side. Initially a description will be made of the control of the air-fuel ratio feedback correction coefficient $C_{FB}$ which is performed based on the output signal of the air-fuel ratio sensor 16.

Figure 3:
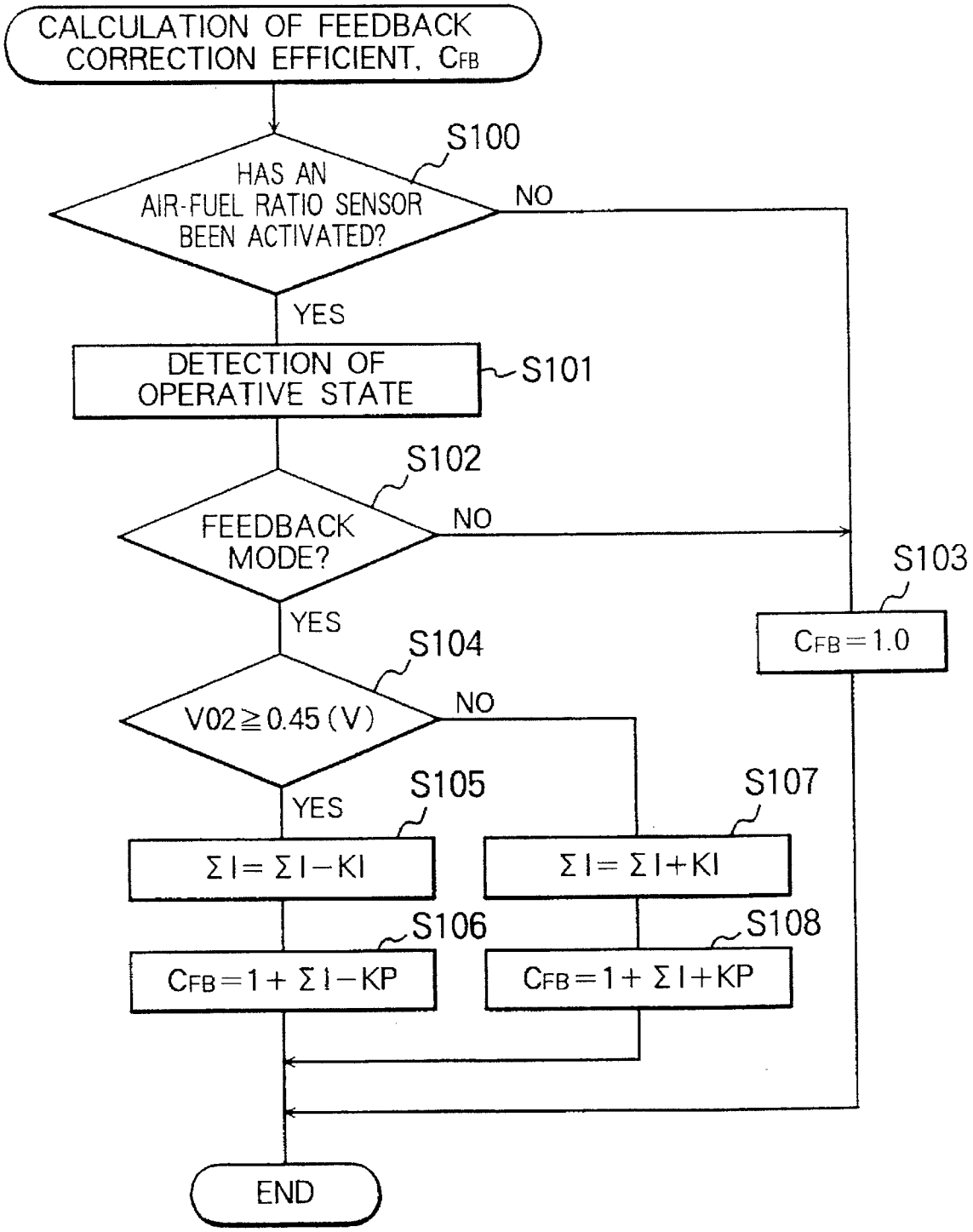
FIG. 3 is a flowchart showing how an air-fuel feedback correction coefficient is calculated.

FIG. 3 shows the routine of calculation of the air-fuel ratio feedback-correction coefficient $C_{FB}$. Initially, it is judged in step S100 whether the air-fuel ratio sensor 16 has been activated. If the air-fuel ratio sensor 16 has not been activated yet, step S100 will advance to step S103. In step S103, $C_{BF}$ is set to 1.0 and the processing is ended. If the air-fuel ratio sensor 16 has been activated, step S100 will advance to step S101. In step S101 the output signals of the crank angle sensor 17, the air flow sensor 2, the throttle sensor 12, and the water temperature sensor 14 are taken in and the operative state of the engine is detected. Then, in step S102 it is judged whether the engine is in the feedback mode from the operative state of the engine detected in step S101. If the engine is in the enrich mode or in the fuel cut mode, i.e., if the engine is not in the feedback mode, step S102 will advance to step S103. In step S103, $C_{BF}$ is set to 1.0 and the processing is ended. If, on the other hand, the engine is in the feedback mode, step S102 will advance to step S104. In step S104 whether the output voltage $V_{02}$ of the air-fuel ratio sensor 16 is greater than 0.45 V, i.e., whether the air-fuel ratio is rich is judged. If $V_{02}\geqq 0.45$ V, step 104 will advance to step S105. In step S105 a relatively small integration value KI is subtracted from a feedback integration correction coefficient integrated value Σl which will be described later. In step S106, the feedback integration correction coefficient integrated value Σl, obtained in step S105, is added to 1.0 which is the reference value of the air-fuel ratio feedback correction coefficient $C_{FB}$, and then a relatively large skip value KP is subtracted from the added value, thereby calculating the air-fuel ratio feedback correction coefficient $C_{FB}$.

When, on the other hand, $V_{02}<0.45$ V, i.e., when the air-fuel ratio is thin, step S104 advances to step S107. In step S107 a relatively small integration value KI is added to the feedback integration correction coefficient integrated value Σl. In step S108, the feedback integration correction coefficient integrated value Σl, obtained in step S107, is added to 1.0 which is the reference value of the air-fuel ratio feedback correction coefficient $C_{FB}$, and then a relatively large skip value KP is added to the added value, thereby calculating the air-fuel ratio feedback correction coefficient $C_{FB}$. Note that the feedback integration correction coefficient integrated value $\Sigma I$ is a value which varies depending upon the state of the purge control, as will be described in detail later.

Therefore, in steps S105 to S107 the air-fuel ratio feedback correction coefficient $C_{FB}$ is corrected according to the state of the purge control.

As described above, in the case of "rich", the air-fuel ratio feedback correction coefficient $C_{FB}$ becomes small so that the fuel injection amount becomes small, and in the case of "thin", the air-fuel ratio feedback correction coefficient $C_{FB}$ becomes large so that the fuel injection amount becomes large. As a result, the air-fuel ratio is to be maintained to a stoichiometric air-fuel ratio. Note that, under the condition the purge control is not performed, the air-fuel ratio feedback correction coefficient $C_{FB}$ is fluctuating with near 1.0 as center.

Now, a description will be made of the purge control. In the internal combustion engine shown in FIG. 1, the purge control valve is duty-controlled at intervals of a drive cycle of 100 ms through the drive circuit 25 by the engine control unit 20. The purge control value "ON" time $T_{PRG}$ is calculated based on the following equation.

$$T_{PRG}=PRG_{BSE}\times K_{PRG}\times K_X \quad (2)$$

where $PRGb_{BSE}$ is a basic purge control valve "ON" time, $K_{PRG}$ is an initial purge flow reducing coefficient, and $K_X$ is a correction coefficient.

The correction coefficient $K_X$ represents water-temperature and intake-temperature coefficients together and normally becomes 1.0 after an idling operation of the engine. The basic purge control valve "ON" time $PRG_{BSE}$ is a two-dimensional map consisting of an engine speed $N_e$ and a charging efficiency $E_c$. The engine speed $N_e$ is calculated from the crank angle sensor 17, and the charging efficiency $E_c$ is calculated from the engine speed $N_e$ and the intake air quantity $Q_a$ measured by the air flow sensor 2. The purge control valve "ON" time is set so that a purge rate becomes a constant. The initial purge flow reducing coefficient $K_{PRG}$ is a coefficient with which a reducing correction is made so that a large quantity of purge air is supplied when the absorption state of the evaporative fuel to the canister is unclear after starting. The initial purge flow reducing coefficient $K_{PRG}$ is calculated based on the following equation.

$$K_{PRG}=\min\{K_{KPRG}\times\Sigma Q_{PRG}+K_{PGOFS},1.0\} \quad (3)$$

where $K_{KPRG}$ represents a purge flow initially reducing coefficient gain, $\Sigma Q_{PRG}$ represents a purge flow integrated value, and $K_{PGOFS}$ represents a purge flow initially reducing coefficient offset. The aforementioned equation (3) means that ($K_{KPRG}\times\Sigma Q_{PRG}+K_{PGOFS}$) and 1.0 are compared and then a smaller one is taken.

The purge flow integrated value $\Sigma Q_{PRG}$ is an integrated value of purge quantities after starting, and the initial value after starting is 0. The purge flow initially reducing coefficient offset $K_{PRG}$ becomes an initial value of the initial purge flow reducing coefficient $K_{PRG}$ after starting, because the purge flow integrated value $\Sigma Q_{PRG}$ after starting is 0. The purge flow initially reducing coefficient gain $K_{KPRG}$ is an increase rate of the initial purge flow reducing coefficient $K_{PRG}$. Therefore, the initial purge flow reducing coefficient $K_{PRG}$ assumes the initial value of the purge flow reducing coefficient offset $K_{PRG}$ after starting. Then, the initial purge flow reducing coefficient $K_{PRG}$ is increased at the increase rate of the initial purge flow reducing coefficient $K_{KPRG}$, as the purge control advances. Finally, the initial purge flow reducing coefficient $K_{KPRG}$ is limited at a maximum of 1.0.

With the aforementioned operation of the initial purge flow reducing coefficient $K_{PRG}$, the purge control value "ON" time $T_{PRG}$ assumes a value reduced by the basic purge control valve "ON" time at the time of starting, and gradually increases up to the basic purge control valve "ON" time $PRG_{BSE}$, as the purge control advances.

Figure 10:
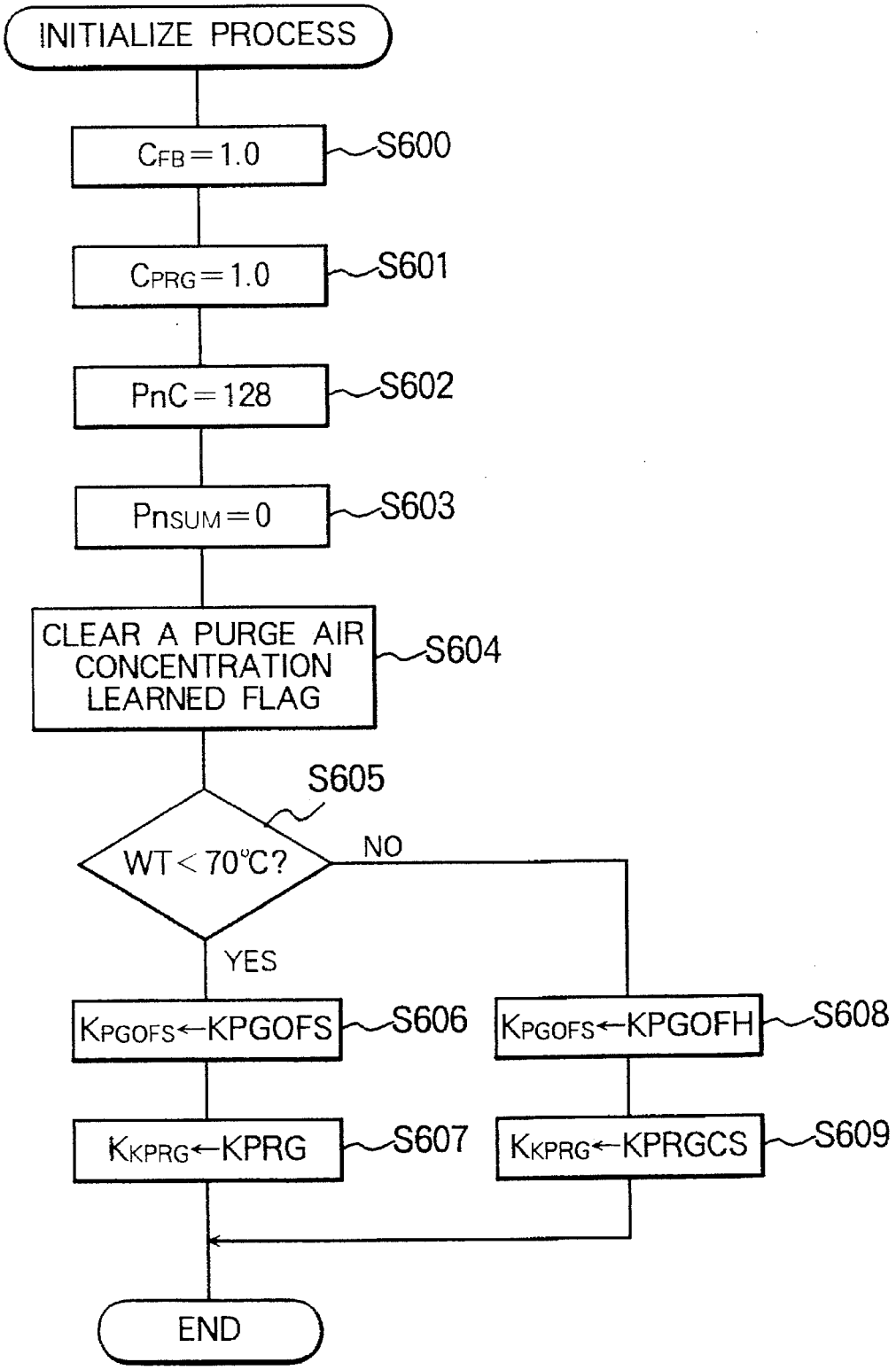
FIG. 10 is a flowchart showing how an initialize process is performed.

The purge flow initially reducing coefficient gain $K_{KPRG}$ and the purge flow reducing coefficient offset $K_{PGOFS}$ are set in steps S605 to S609 of an initialize process routine of FIG. 10 and assume different values in accordance with the cooling-water temperatures of the engine.

FIG. 10 shows an initialize process which is performed when electric power is supplied to the engine control unit 20. In steps S600 to S603 each variable is given an initial value. In step S604 a purge air concentration learned flag is cleared. In steps S605 to S609 each variable is given an initial value in accordance with a temperature of the engine.

In step S605 whether the idling operation of the engine has been completed is judged. If YES, in step S606 the value of the purge air flow initially reducing coefficient offset $K_{PGOFS}$ will be set to a previously set value which is used when the engine is started at a low temperature. Also, in the subsequent step S607 the value of the purge air flow initially reducing coefficient gain $K_{KPRG}$, will be set to a previously set value which is used when the engine is started at a low temperature.

When, on the other hand, it is judged that the idling operation of the engine has not been completed yet, step S605 will advance to step S608. In step S608 the value of the purge air flow initially reducing coefficient offset $K_{PGOFS}$ will be set to a high-temperature start-time purge air flow initially reducing coefficient offset $K_{PGOFH}$. In the subsequent step S609 the value of the purge air flow initially reducing coefficient gain $K_{KPRG}$ Will be set to a high-temperature start-time purge air flow initially reducing coefficient gain $K_{PRGCS}$.

The relationships between the offset value and the gain at the time of the low-temperature start and at the time of the high-temperature start are as follows.

Offset: $K_{PGOFS}>K_{PGOFH}$

Gain: $K_{PRG}>K_{PRGCS}$

The offset value of the fuel evaporative gas, absorbed to the activated charcoals of the canister, is set to a greater value at the time of a low temperature than at the time of a high temperature, because normally the fuel evaporative gas is difficult to remove from the activated charcoals when the temperature of the canister is low. Also, if the temperature of the canister rises due to idling of engine and the fuel evaporative gas becomes easy to remove, the gain of the fuel evaporative gas, which determines the increase speed of the purge air flow reducing coefficient by the fact that the fuel evaporative gas to the canister is unknown, will be set to a lesser value.

On the other hand, at the time of high-temperature start the offset value is set to a less value, because the temperature of the canister is high and the fuel evaporative gas has become easy to remove.

Figure 4:
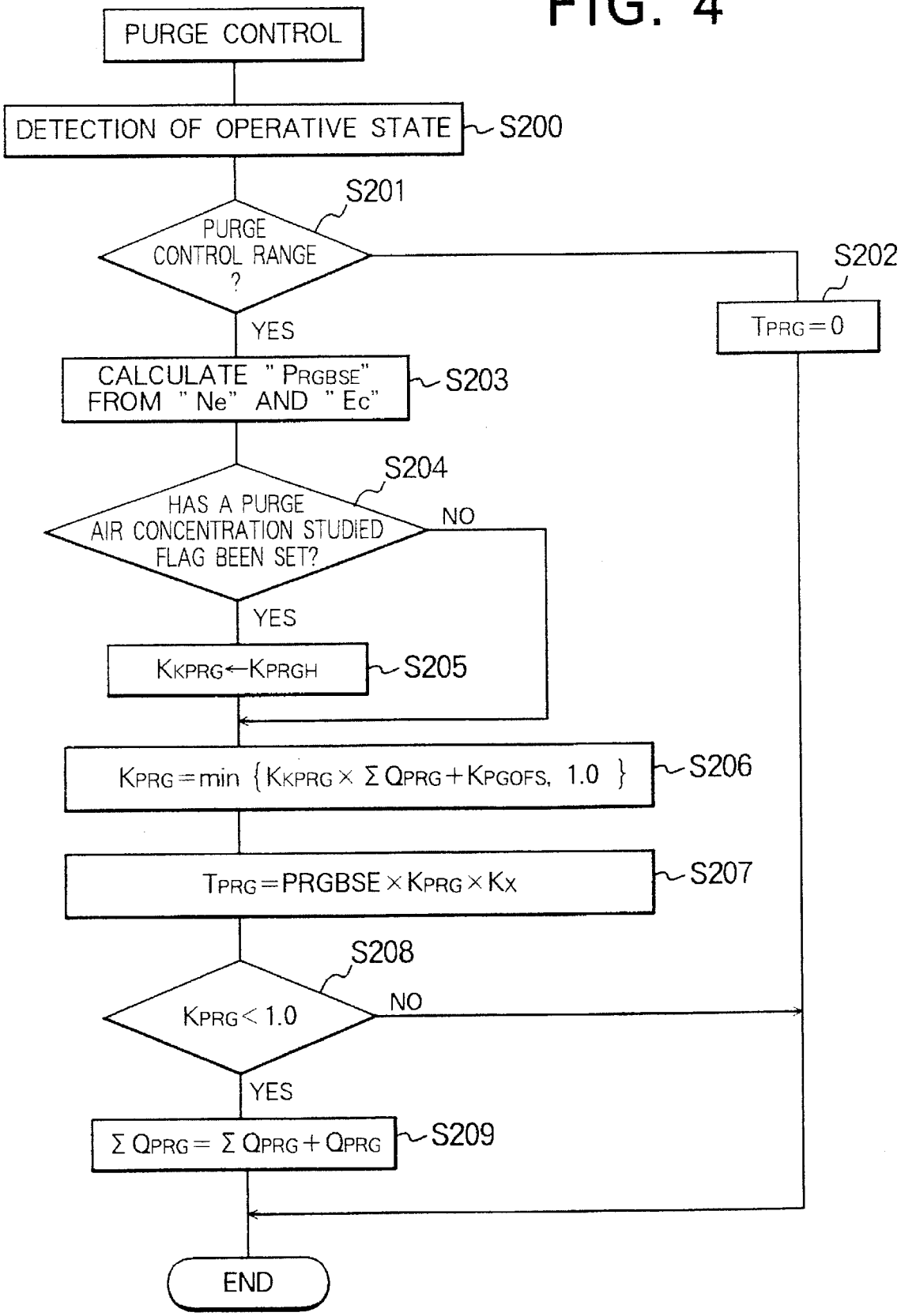
FIG. 4 is a flowchart showing how a purge control is performed.

FIG. 4 shows how the purge control is performed. Now, the purge control will be described in greater detail in reference to FIG. 4. Initially, in step S200 the output signals of the crank angle sensor 17, the air flow sensor 2, the throttle sensor 12, and the water temperature sensor 14 are taken in and the operative state of the engine is detected. Then, in step S201 whether the engine is within a purge control range is judged from the operative state detected in step S200. If the engine is not within the purge control range, step S201 will advance to step S202. In step S202, $T_{PRG}$ is set to 0 ms. That is, the purge control value is closed and the processing is ended. If, on the other hand, the engine is within the purge control range, step S201 will advance to step S203. In step S203, from the previously stored map of the basic purge control valve "ON" time $PRG_{BSE}$ of FIG. 5, the purge control valve "ON" time is calculated based on the engine speed $N_e$ and the charging efficiency $E_c$. For the purge flow reference value $Q_{PRGBSE}$ shown in FIG. 5, quantities of purge air are experimentally obtained when the purge control value is controlled with the aforementioned purge control valve "ON" time, and the obtained values are mapped.

In step S204 it is judged whether the purge air concentration learned flag has been set. If the flag has not been set, i.e., if the purge air concentration learning has not been learned yet, then step S204 will advance to step S206. If, on the other hand, the flag has been set, i.e., if the purge air concentration learning has been completed, then step S204 will advance to step S205. In step S205, the purge flow reducing coefficient gain $K_{KPRG}$, which has been set at the time of the initialize process, is reset to $K_{PRGH}$. The $K_{PRGH}$ assumes a value greater than that of the $K_{KPRG}$ which is set at the time of the initialize process so that, after completion of the purge air concentration learning, the purge control quantity is increased quicker than at the time the purge air concentration has not been learned. This is done in order that a larger quantity of purge air can be introduced, because the fuel-air ratio is not influenced after completion of the purge air concentration learning by a change in the purge rate.

In step S206 the initial purge flow reducing coefficient $K_{PRG}$ is calculated. In the subsequent step S207 the purge control valve "ON" time $T_{PRG}$ is calculated, based on the basic purge control valve "ON" time $P_{PGBSE}$ calculated in step S203 and on the initial purge flow reducing coefficient $K_{PRG}$ calculated in step S206. In the subsequent step 208 whether the initial purge flow reducing coefficient $K_{PRG}<1.0$ is judged. If $K_{PRG}\geqq 1.0$, then step S208 will advance to step S202, in which the processing is ended. If $K_{PRG}<1.0$, then step S208 will advance to step S209. In step S209 a quantity of purge air $Q_{PRG}$ corresponding to the purge control valve "ON" time, calculated in step S207, is added to the purge quantity integrated value $\Sigma Q_{PRG}$, and the processing is ended. A method of calculating a quantity of purge air $Q_{PRG}$ will be described in the following part where a calculation of a purge rate $P_r$ is described.

Figure 6:
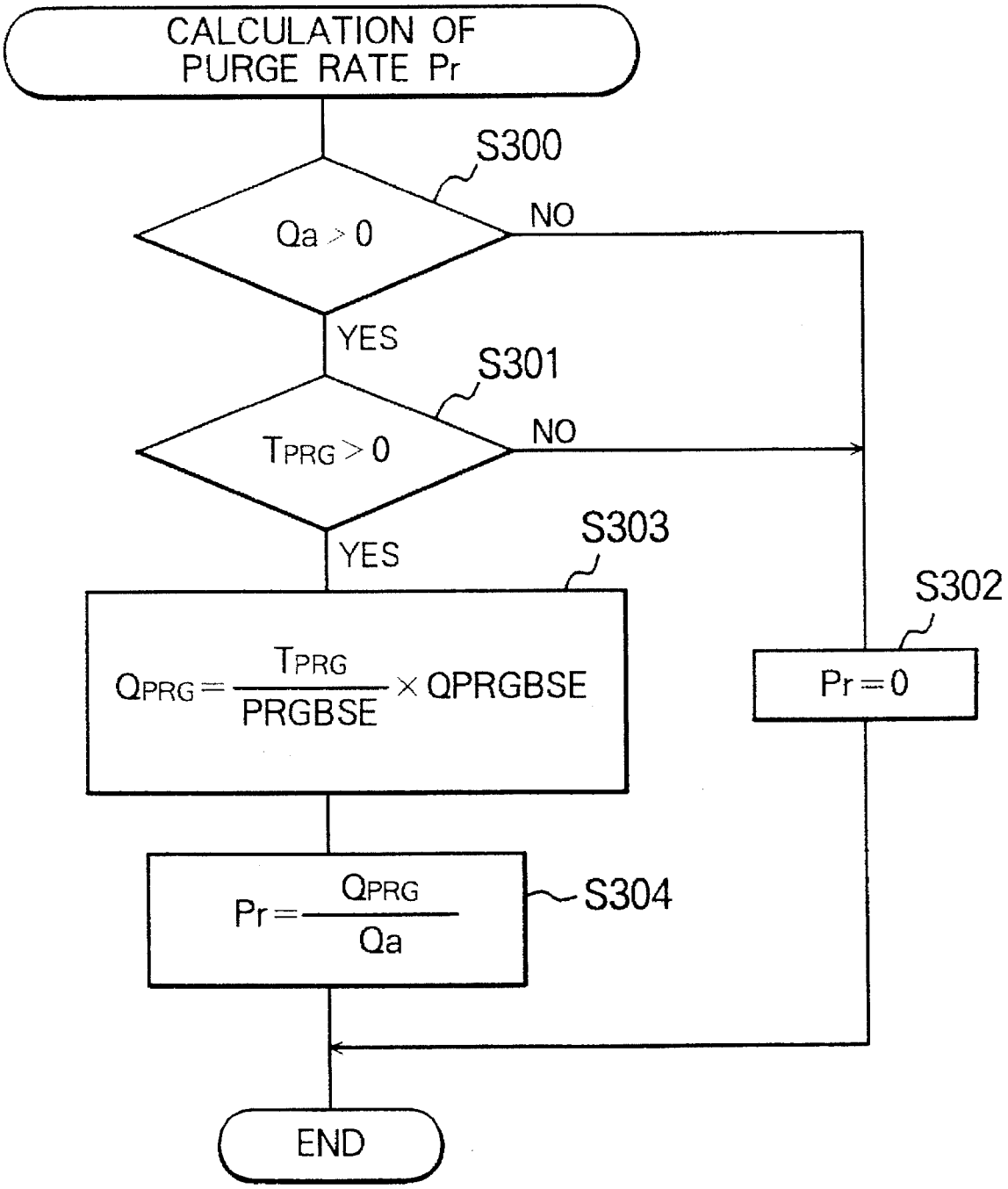
FIG. 6 is a flowchart showing how a purge rate is calculated.

Now, a description will be made of the calculation of the purge rate $P_r$. The calculation of the purge rate $P_r$ is shown in a flowchart of FIG. 6. Initially, in step S300 whether quantity of intake air $Q_a>0$ is judged. If quantity of intake air $Q_a\leqq 0$, step S300 will advance to S302. In step S302 the purge rate $P_r$ is set to 0 and the processing is ended. If quantity of intake air $Q_a>0$, step S300 will advance to S301. In step S301 whether purge control valve "ON" time>0 is judged. If purge control valve "ON" time≦0, step S301 will advance to S302. In step S302 the purge control valve "ON" time is set to 0 and the processing is ended. If purge control valve "ON" time>0, step S301 will advance to S303. In step S303 the quantity of purge air $Q_{PRG}$ is calculated based on the purge control valve "ON" time and on the basic purge control valve "ON" time $P_{PGBSE}$ and purge flow reference value $Q_{PRGBSE}$ of FIG. 5. Finally, in step S304 the purge rate $P_r$ is calculated based on the purge air quantity $Q_{PRG}$ calculated in step S303 and the intake air quantity $Q_a$, and the processing is ended. Note that the calculation routine of the purge rate $P_r$ is performed at intervals of the signal rise time of the crank angle sensor 17.

Now, a description will be made of the purge air concentration learning. The purge air concentration learning is shown in a flowchart of FIG. 7.

Initially, in step S400 whether purge rate $P_r\geqq 1\%$ is judged. If purge rate $P_r<1\%$, step S400 will advance to S412. In step S412, a purge air concentration integrated value $P_{nsuM}$ is set to 0 and the processing is ended. If purge rate $P_r\geqq 1\%$, step S400 will advance to S401. The reason that the purge air concentration is not calculated at the time of purge rate $P_r<1\%$ is because, when a shift in the air-fuel ratio occurs due to factors other than the purge control, for example, the aged deterioration of the air flow sensor and the fluctuation in the characteristic of the injector, an error in the calculation result of the purge air concentration will be larger if the purge rate $P_r$ is smaller. Step S400 constitutes inhibition means for inhibiting updating of the purge air concentration.

In step S401 a purge air concentration $P_n$ is calculated based on the purge rate $P_r$ the air-fuel feedback correction coefficient $C_{FB}$, and a purge air concentration correction coefficient $C_{PRG}$ to be described later.

In step S402, the purge air concentration $P_n$, calculated in step S401, is added to the purge air concentration integrated value $P_{nSUM}$. In step S403 a purge air concentration integrating counter PnC is decremented. And, in step S404 whether PnC=0 is judged. If PnC>0, the processing will be ended. If PnC=0, step S404 will advance to step S405. In step S405 a purge air concentration average value $P_{NAVE}$ is calculated from the purge air concentration integrated value $P_{nSUM}$. The reason that the purge air concentration integrated value is divided by 128 is because the purge air concentration counter has been set to 128 at the time of the initialize process and also the purge air concentration integrated value $P_{nSUM}$ is obtained by integrating the purge air concentration 128 times. Also, since the routine of this purge air concentration learning is also processed at intervals of the signal rise time of the crank angle sensor, the purge air concentration average value $P_{nave}$ is to be updated at intervals of 128 rise times of the crank angle sensor signal.

In step S406 it is judged whether a purge air concentration learning condition has been established. If the condition has not been established, step S406 will advance to S412. In step S412, the purge air concentration integrated value $P_{nSUM}$ is set to 0 and the processing is ended. If, on the other hand, the condition has been established, step S406 will advance to S407. In step S407 whether the purge air concentration learned flag has been set is judged. If the flag has been set, step S407 will advance to step S408 because the purge air concentration is calculated for the first time after starting of the engine. In step S408, the purge air concentration average value $P_{nave}$ calculated in step S405, is set to a purge air concentration learning value $P_{nf}$. In step S409 the purge air concentration learned flag is set, and in step S412 the purge air concentration integrated value $P_{nSUM}$ is set to 0 and the processing is ended. At this time, by setting the purge air concentration average value $P_{nave}$ to the purge air concentration learning $P_{nf}$ without filtering the purge air concentration average value $P_{nave}$, an actual purge air concentration learning value $P_{nf}$ can be obtained early. If, on the other hand, the purge air concentration learned flag has been set, step S410 will advance to step S410. In step S410 the purge air concentration learning value $P_{nf}$ is calculated by filtering the purge air concentration average value with a filter constant KF ($1>KF\geqq 0$). In step S411 the PnC is set to 128, and in step S412 the purge air concentration integrated value $P_{nSUM}$ is set to 0 and the processing is ended.

Figure 7:
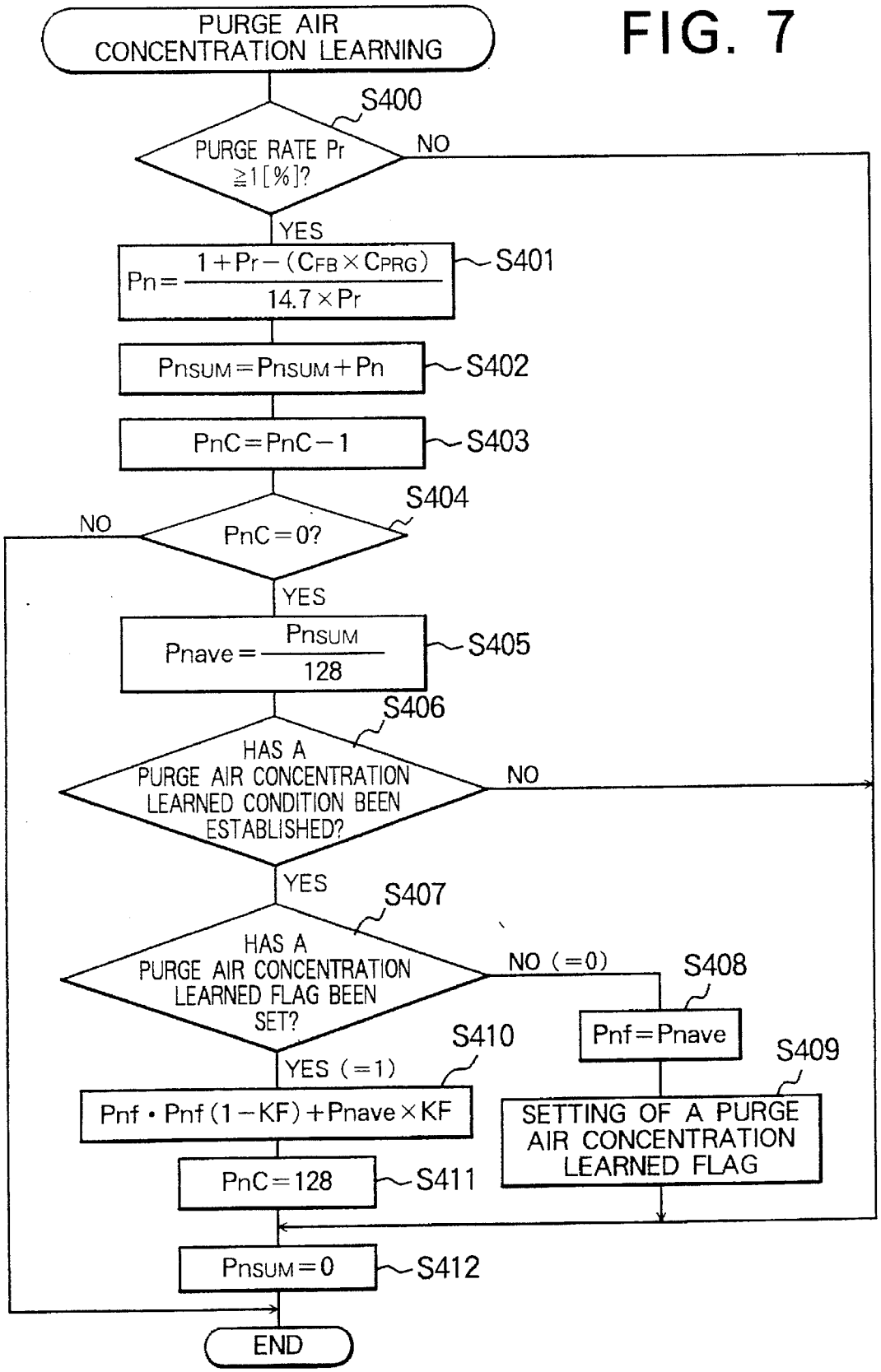
FIG. 7 is a flowchart showing how a purge air concentration is learned.

Note that the flowchart of FIG. 7 constitutes purge air concentration learning calculation means.

Now, a description will be made of the calculation of the purge air concentration learning correction coefficient $C_{PRG}$.

Figure 8:
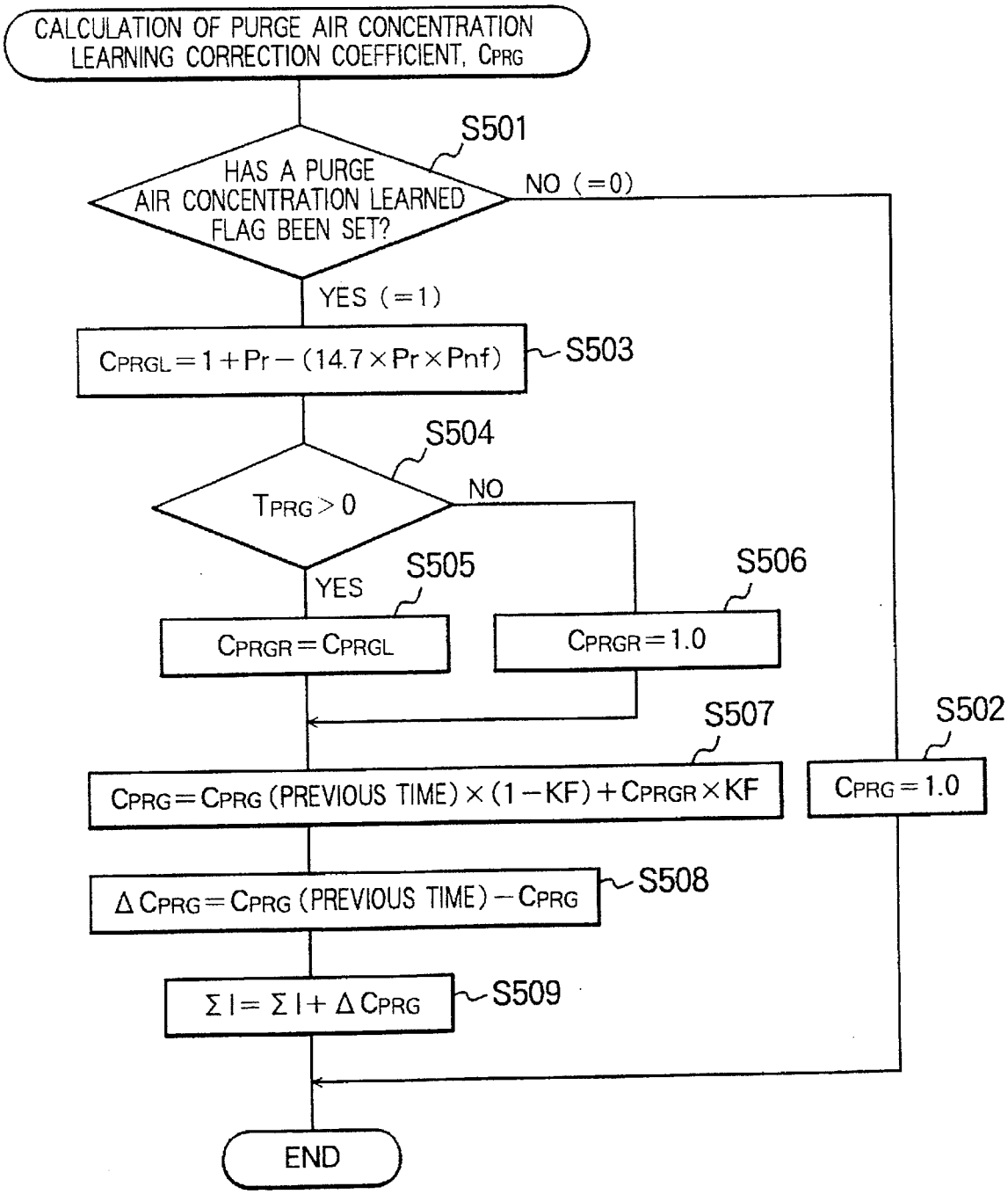
FIG. 8 is a flowchart showing how a purge air concentration learning correction coefficient is calculated.

The calculation of the purge air concentration learning correction coefficient $C_{PRG}$ is shown in a flowchart of FIG. 8.

Initially, in step S501 whether the purge air concentration learned flag has been set is judged. If the flag has not been set, i.e., if the purge air concentration learning has not been learned, step S501 will advance to S502. In step S502, the $C_{PRG}$ is set to 0 and the processing is ended. If, on the other hand, the flag has not been set, i.e., if the purge air concentration learning has been learned, step S501 will advance to S503. In step S503 a purge air concentration instantaneous learning value $C_{PRGL}$ is calculated based on the purge rate $P_r$ and the purge air concentration learning value $P_{nf}$. In the following step S504 it is judged whether purge control valve "ON" time $T_{PRRG}>0$. If $T_{PRG}\leqq 0$, step S504 will advance to step S506. In step S506 $C_{PRGR}$ is to 1.0, and step S506 advances to step S507. If, on the other hand, $T_{PRG}>0$, step S504 will advance to step S505. In step S505 the purge air concentration instantaneous learning value $C_{PRGL}$, calculated in step S503, is set to $C_{PPRG}$, and step S505 advances to step S507. In step S507, the $C_{PPRG}$, obtained in the previous step, is filtered with a filter constant KF ($1>KF\geqq 0$), and the purge air concentration learning correction coefficient $C_{PRG}$ is calculated.

In step S508 a value, obtained by subtracting the presently obtained purge air concentration learning correction coefficient $C_{PRG}$ from the previous purge air concentration learning correction coefficient $C_{PRG}$, is set to $\Delta C_{PRG}$. In step S509 a value, obtained by subtracting the $\Delta C_{PRG}$ obtained in step S508 from the feedback integration correction coefficient integrated value $\Sigma I$, is set to a new feedback integration correction coefficient integrated value $\Sigma I$, and the processing is ended.

This feedback integration correction coefficient integrated value $\Sigma I$ is used in the calculation of the aforementioned air-fuel feedback correction coefficient $C_{FB}$.

Figure 9:
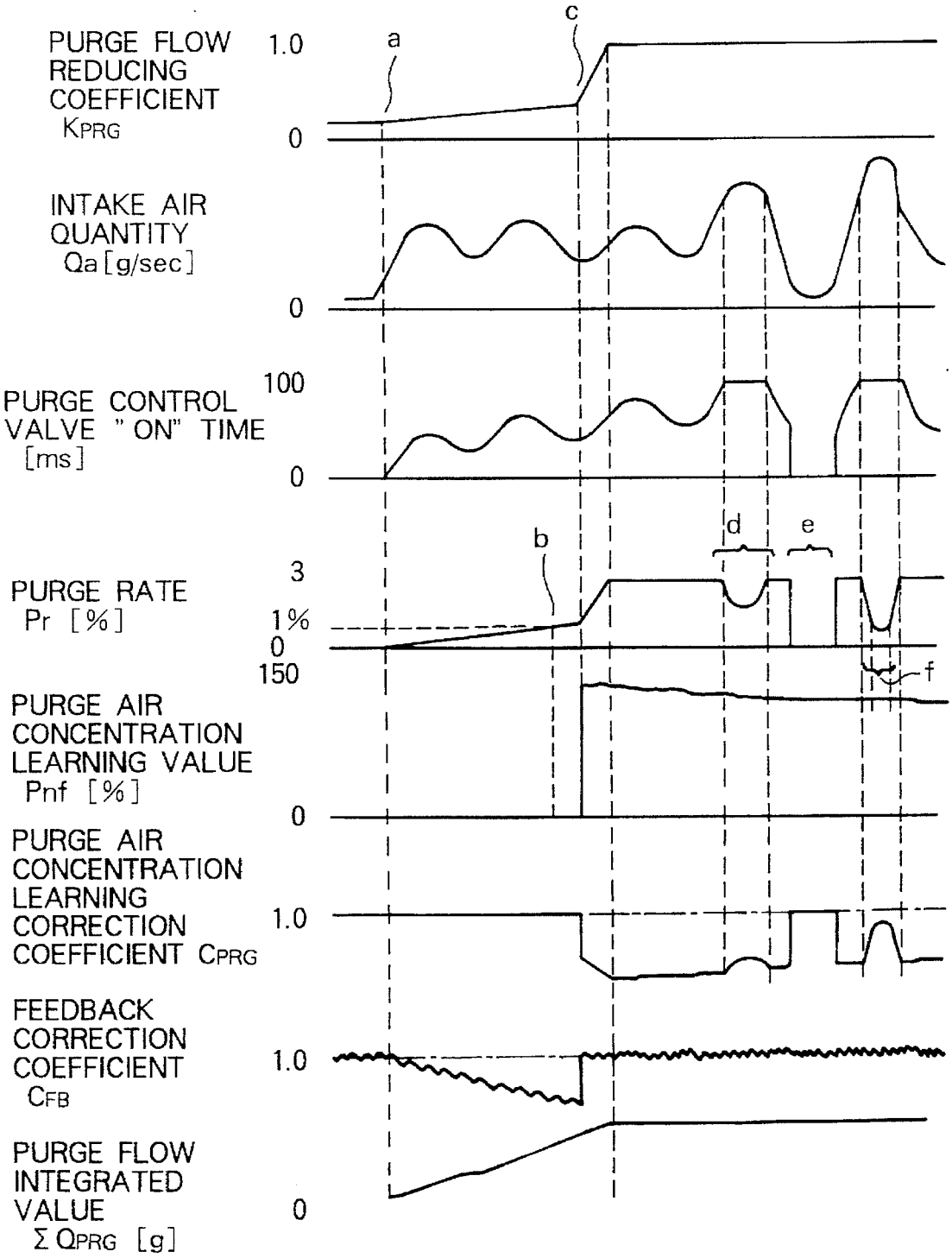
FIG. 9 is a timing chart showing the operation of the present invention.

Finally, the operation will be described with a timing chart of FIG. 9. Until purge air is introduced after starting of the engine, the purge flow reducing coefficient $K_{PRG}$ assumes the value of the purge flow reducing coefficient offset $K_{PGOFS}$ which is determined by a water temperature at the time of starting. If the purge air begins to be introduced at an a-point, then the purge rate $P_r$ and the purge flow integrated value $\Sigma Q_{PRG}$ will be calculated. At the same time, the purge flow reducing coefficient $K_{KPRG}$ will increase at the gradient of the purge flow reducing coefficient gain $K_{KPRG}$ which is determined by a water temperature at the time of starting. As the purge flow reducing coefficient $K_{PRG}$ increases, the purge control valve "ON" time also becomes longer. At the time the purge rate has reached 1% at a b-point, ignition is performed 128 times, and then the purge air concentration learning value Pnf and the purge air concentration learning correction coefficient $C_{PRG}$ are calculated. Then, the value $\Delta C_{PRG}$, obtained by subtracting the present purge air concentration learning correction coefficient from the previous purge air concentration learning correction coefficient, is added to the air-fuel feedback correction coefficient $C_{FB}$. Also, the increase speed of the purge flow reducing coefficient $K_{PRG}$ becomes faster because the purge flow reducing coefficient gain $K_{KPRG}$ assumes a large value at a c-point where the purge air concentration learning value Pnf is obtained. The purge flow reducing coefficient $K_{PRG}$ is limited at 1.0 and also the integration of the purge flow integrated value $\Sigma Q_{PRG}$ is stopped.

In a case such as a d-point where the next operative state, the fluctuation in the air-fuel feedback correction coefficient $C_{BF}$ is suppressed because the purge air concentration learning correction coefficient $C_{PRG}$ is increased as the purge rate is reduced. When no purge air is introduced at an e-point, the purge air concentration learning correction coefficient $CR_{PRG}$ assumes 1.0. Therefore, even in this case, no fluctuation in the air-fuel feedback correction coefficient $C_{BF}$ occurs. Even in a case such as an f-point where the last operative state is in a very high load, the fluctuation in the air-fuel feedback correction coefficient $C_{BF}$ is suppressed because the purge air concentration learning correction coefficient $C_{PRG}$ is increased as the purge rate is reduced. At the same time, when the purge rate is less than 1%, the updating of the purge air concentration learning value Pnf is prohibited for avoiding a mistaken learning of the purge air concentration learning.

While the invention has been described with reference to a specific embodiment thereof, it will be appreciated by those skilled in the art that numerous variations, modifications, and embodiments are possible, and accordingly, all such variations, modifications, and embodiments are to be regarded as being within the scope of the invention.

What is claimed is:

1. An air-fuel ratio control apparatus for an internal combustion engine, comprising:

operative state detection means for detecting an operative state of said internal combustion engine;

purge quantity control means for controlling a quantity of purge air that is introduced into an engine intake system, based on a detection output of said operative state detection means;

purge quantity calculation means for calculating said purge air quantity that is introduced into said engine intake system by said purge quantity control means;

purge rate calculation means for calculating a purge rate from said purge air quantity calculated by said purge quantity calculation means and from said operative state detected by said operative state detection means;

an air-fuel ratio sensor for sensing an air-fuel ratio of an air-fuel mixture supplied to said internal combustion engine;

air-fuel ratio control means for controlling an air-fuel ratio feedback correction coefficient which makes a correction so that said air-fuel ratio of said air-fuel mixture, which is supplied to said internal combustion engine, becomes a target value, based on an output of said air-fuel ratio sensor;

purge air concentration calculation means for calculating a purge air concentration from said purge rate and said air-fuel ratio feedback correction coefficient;

purge air concentration correction means for calculating a purge air concentration correction coefficient, based on said purge rate and said purge air concentration; and fuel injection quantity calculation means for calculating an injection quantity of fuel which is supplied to said internal combustion engine, based on said air-fuel ratio feedback correction coefficient and said purge air concentration correction coefficient.

2. The air-fuel ratio control apparatus as set forth in claim 1, wherein said air-fuel ratio feedback correction coefficient is controlled to said target value by correcting said injection quantity of fuel in accordance with said purge rate and said purge air concentration.

3. The air-fuel ratio control apparatus as set forth in claim 1, further comprising purge air concentration learning value calculation means for filtering said purge air concentration calculated by said purge air concentration calculation means and then calculating a purge air concentration learning value, and wherein, when said purge air concentration calculation means calculates said purge air concentration for the first time after starting of said internal combustion engine, a result of the calculation is set to said purge air concentration learning value without filtering the result of the calculation.

4. The air-fuel ratio control apparatus as set forth in claim 1, further comprising inhibition means for inhibiting updating of said purge air concentration when said purge rate is less than a predetermined value.

5. The air-fuel ratio control apparatus as set forth in claim 3, wherein an increase rate of said purge air quantity, which is incremented after starting of said internal combustion engine, is made greater after calculation of said purge air concentration than before the calculation.

* * * * *